US010473431B2

(12) United States Patent
Biddle

(10) Patent No.: US 10,473,431 B2
(45) Date of Patent: Nov. 12, 2019

(54) SIGHT TRAINING AID ATTACHMENT

(71) Applicant: Anthony Biddle, Altoona, PA (US)

(72) Inventor: Anthony Biddle, Altoona, PA (US)

(73) Assignee: YNOT Distributing, LLC, Altoona, PA (US)

( * ) Notice: Subject to any disclaimer, the term of this patent is extended or adjusted under 35 U.S.C. 154(b) by 164 days.

(21) Appl. No.: 15/723,113

(22) Filed: Oct. 2, 2017

(65) Prior Publication Data

US 2018/0094901 A1 Apr. 5, 2018

Related U.S. Application Data

(60) Provisional application No. 62/403,672, filed on Oct. 3, 2016.

(51) Int. Cl.

| | |
|---|---|
| ***F41G 3/26*** | (2006.01) |
| ***F41G 11/00*** | (2006.01) |
| ***F41G 1/08*** | (2006.01) |
| *F41C 3/00* | (2006.01) |

(52) U.S. Cl.

CPC ..... *F41G 3/26* (2013.01); *F41G 1/08* (2013.01); *F41G 11/001* (2013.01); *F41C 3/00* (2013.01)

(58) Field of Classification Search

USPC ..... 434/11, 16, 19; 42/111, 124, 143, 148

See application file for complete search history.

(56) References Cited

U.S. PATENT DOCUMENTS

| | | | | | |
|---|---|---|---|---|---|
| 1,507,223 | A * | 9/1924 | Winter | F41G 3/26 | 434/19 |
| 2,319,787 | A * | 5/1943 | Black | F41G 3/26 | 434/19 |
| 3,838,522 | A * | 10/1974 | Williams | F41G 1/28 | 42/137 |
| 4,245,402 | A * | 1/1981 | Lanese | F41G 3/26 | 434/19 |
| 4,494,327 | A * | 1/1985 | Cullity | F41G 1/06 | 42/132 |
| 4,811,955 | A * | 3/1989 | De Bernardini | F41A 19/16 | 124/32 |
| 4,945,667 | A * | 8/1990 | Rogalski | F41G 1/34 | 42/114 |
| 5,467,552 | A * | 11/1995 | Cupp | F41G 1/26 | 42/125 |
| D393,306 | S * | 4/1998 | Couper | 42/112 | |
| 6,016,608 | A * | 1/2000 | Lorocco | F41G 1/345 | 33/265 |
| 6,068,483 | A * | 5/2000 | Minor | F41G 3/30 | 42/111 |
| 6,571,500 | B2 * | 6/2003 | Keenan | F41A 33/00 | 42/54 |
| 6,578,310 | B1 * | 6/2003 | Schacht | F41G 1/425 | 42/112 |

* cited by examiner

*Primary Examiner* — Kurt Fernstrom
(74) *Attorney, Agent, or Firm* — Penn State Law IP Clinic

(57) ABSTRACT

When a shooter aims down the slide of semi auto handgun needs to align the front sight between the two posts of the rear sight. This is the hardest thing for an instructor to correct not being able to see what the student is looking at. This aid will provide a reference point for the shooter to keep the front sight below, this helps promote proper sight acquisition. This is a plastic hood that slides over top of the rear sight and over the slide. The shooter is able to shoot with this aid on the firearm.

20 Claims, 5 Drawing Sheets

SIGHT TRAINING AID ATTACHMENT

CROSS REFERENCE TO OTHER APPLICATIONS

This application claims priority to U.S. Provisional Application Ser. No. 62/403,672, filed on Oct. 3, 2016.

TECHNICAL FIELD

The invention is related to the field of firearm accessories. In particular, the invention relates to a training aid device used to improve aim.

BACKGROUND OF THE INVENTION

Proper and proficient use of a firearm is an acquired skill. In order to acquire said skill, a great deal of time training with the firearm is necessary. Such training typically includes an understanding of how the firearm operates. This includes loading, unloading, disassembly, and firing. Just as with any other skill, it is imperative that a user develop proper fundamentals early-on when beginning training.

One of the most important aspects of training is learning the components of and how a firearm sight is used. A typical fire arm sight consists of two basic components, a rear sight and a front sight. On most firearms, the rear sight includes a notch while the front sight includes a riser. A properly aimed sight occurs when the firearm is oriented such that the front riser is lined up evenly in the horizontal axis within the notch and the tip of the riser is level with the tip of the notch. In such a configuration, the projectile's trajectory will be towards wherever the front and rear sight are fixed upon.

A common error is to align the rear sight lower than the front sight, thereby firing high of the intended target. Different types of rear sights have been made in order to address this common issue. For example, scopes, reflex sights, laser sights, and the like are commonly used. While these help novice users acquire the target properly they do not instill the proper fundamentals into the novice user. These known devices are also expensive and are not simple to attach to hand-held firearms sometimes requiring modification to the firearm.

What is therefore needed is a sight training aid for a firearm that assists novice users develop proper sight fundamentals. What is also needed is a sight training aid that is easily attachable to the firearm. Additionally, what is needed is a low-cost sight training aid that is simple to manufacture. Finally, what is needed is a sight training aid that may be attached to a multitude of different firearms without modification to the firearm.

SUMMARY AND OBJECTS OF THE INVENTION

A firearm rear sight attachment includes a removable attachment configured for engagement with a firearm. The attachment preferably is removably attached to the firearm with a frictional engagement. The attachment includes a window formed in a portion of the attachment allowing the rear sight of the attachment pass through the window when the attachment is secured to the firearm.

A hoop at least partially covers an area above the window thereby forming a tunnel along the longitudinal axis of the attachment. The rear sight of the firearm is located within the tunnel when the attachment is secured to the firearm. Both the front sight and the rear sight of the firearm may be viewed along the longitudinal axis of the attachment through the tunnel when acquiring a target with the sights. The attachment preferably is formed such that the hoop contacts at least a portion of the rear sight thereby compelling a user to properly observe the rear and front sight by looking into the tunnel of the attachment.

The attachment connects to the firearm with a first leg forming a side of the rear sight attachment and a second leg forming an opposing side of the rear sight attachment. The first and second legs are parallel. A third surface at a center of the rear sight attachment joins the first and second leg. The window is formed in the third surface. The hoop projects from an intersection of the first and second legs with the center third surface, thus forming the tunnel above the window. The attachment preferably attaches to a semi-automatic firearm, above the rear sight.

DETAILED DESCRIPTION

Figure 1:
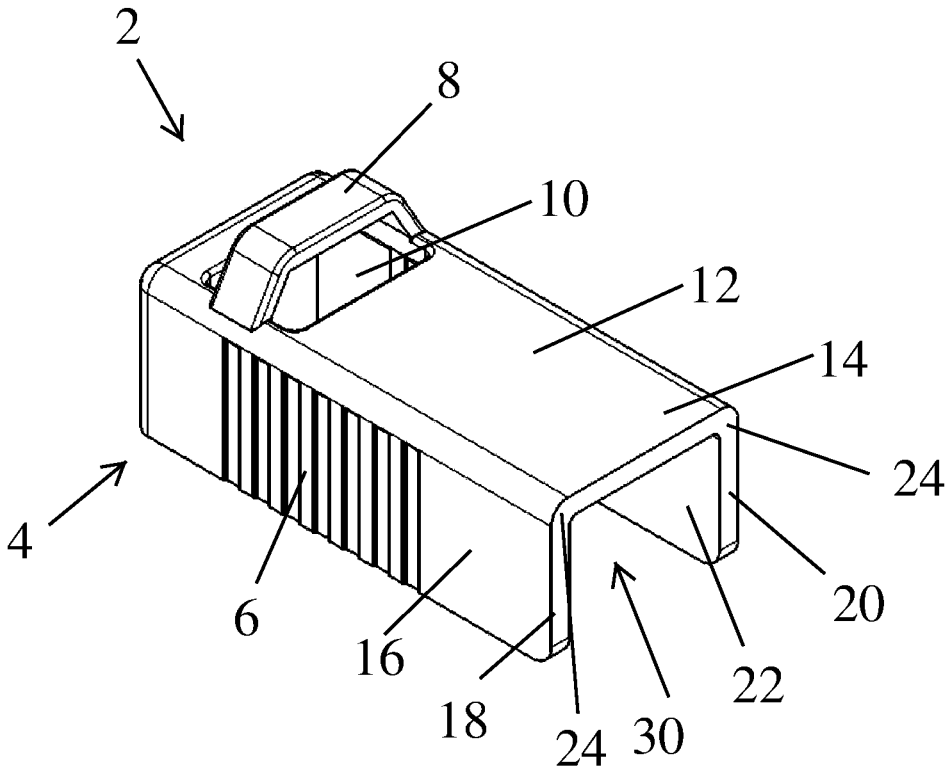
FIG. 1 is a raised, left side perspective view of the sight training aid attachment according to an embodiment of the invention.
Figure 2:
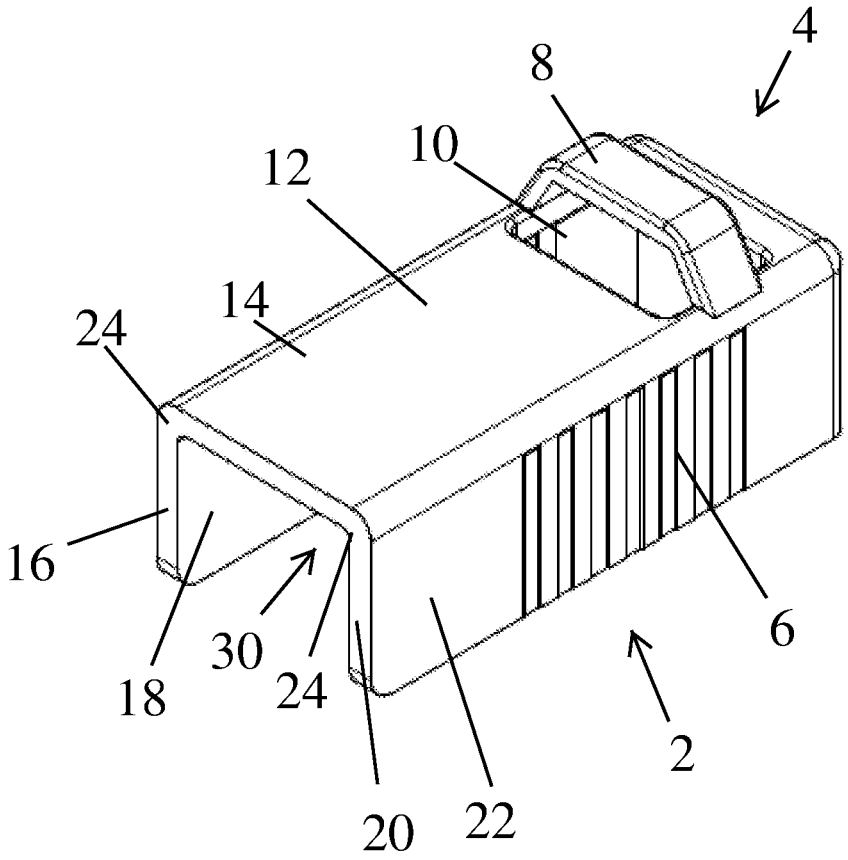
FIG. 2 is a raised, right side perspective view of the sight training aid attachment of FIG. 1.
Figure 3:
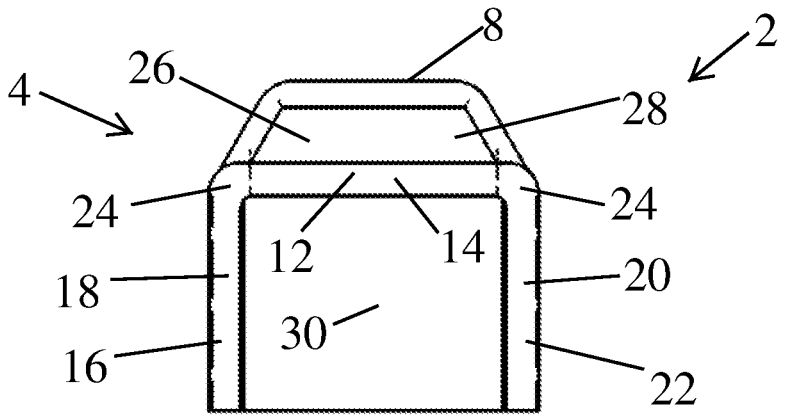
FIG. 3 is a rear view of the sight training aid attachment of FIG. 1.
Figure 4:
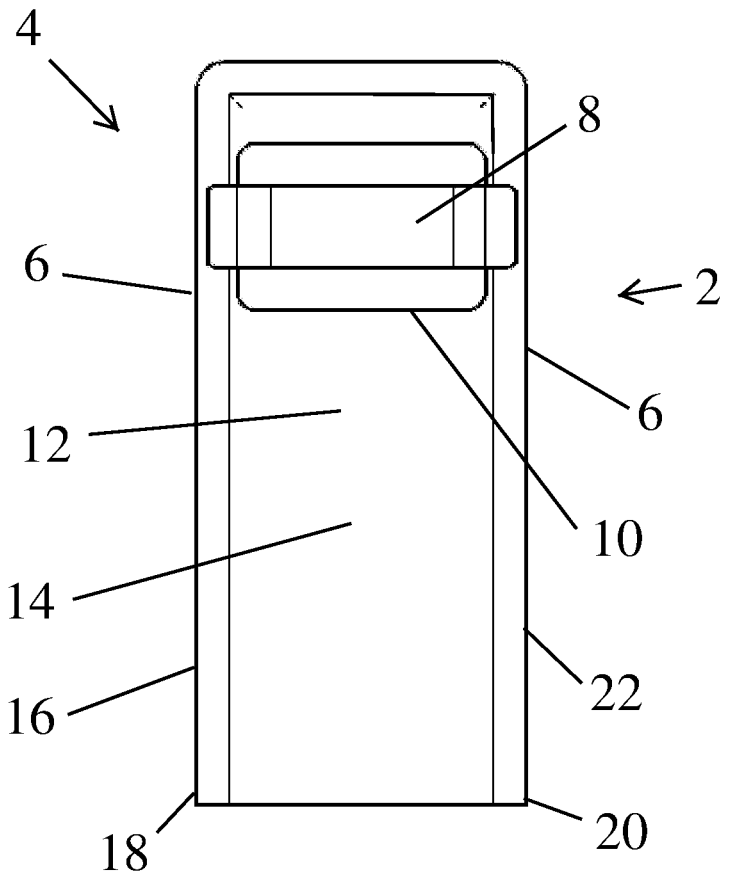
FIG. 4 is a top view of the sight training aid attachment of FIG. 1.

Referring to FIGS. 1-5, the training aid 2 is shown. The training aid 2 is also an attachment 4 designed to interlock with any firearm. Preferably, the training aid 2 attaches to the firearm over the rear sight. When using a semi-automatic handgun, the attachment 4 would attach to the slide over the rear sight. In order to attach the training aid 2 to a firearm, a first leg 18 forms a first surface 16. The first leg attaches to a center 12 at an intersection 24. The intersection 24 joins the first leg 18 to the center 12 at approximately a right angle. Similarly, a second leg 20 forms a second surface 22 that joins the center 12 at an intersection 24. Both intersections are approximately right angles. The intersections 24 need not be limited to right angles but simply join the first leg 18 and second leg 20 to the center 12. The center also forms a third surface 14 which works with the first surface 16 and second surface 22 to attach to a firearm.

The preferred embodiment of the invention is configured for use with a firearm such as a Glock pistol. In order to attach to the rectangular Glock slide, the intersection of the first leg 18 and second leg 20 to the center 12 should form a similar rectangular shape. As a result, the first leg 18 and the second leg 20 form attach to the center 12 forming a rectangular slot 30 which receives the Glock slide.

If the training aid 2 is to be used with another firearm, the first leg 18 and the second leg 20 should join the center 12 with intersections 24 that form a matching shape of the desired firearm. For example, should the training aid 2 be configured for a shotgun, the slot 30 should be shaped such that the slot can snugly mount onto the shotgun in the area of where a rear sight would be located.

The training aid 2 is designed to work complimentary with the rear sight of a firearm. A window 10 forms an opening in the center 12. The window 10 should be shaped of a size large enough to receive the rear sight of the firearm.

Figure 5:
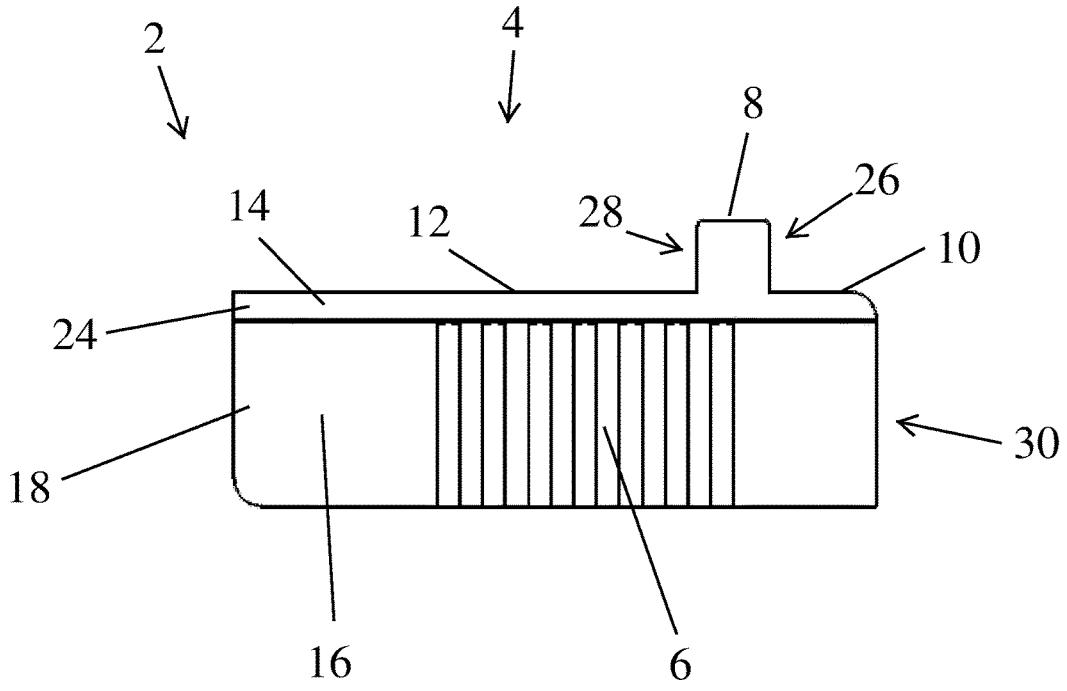
FIG. 5 is a side view of the sight training aid attachment of FIG. 1.

A hood 8 also forms an arch over the window 10 which receives the rear sight of the firearm. Preferably, the hood 8 forms a pocket 28 thereby creating a tunnel 26 as shown in FIG. 5. When looking through the tunnel 25 from the rear of the training aid 2, as shown in FIG. 5, the rear sight of the firearm should be seen. In this manner, a user can take aim and is compelled to look through the tunnel 28 in order to see the rear sight.

The training aid 2 compels the user to properly use the rear sight of the firearm. Novice users have a tendency to not place the front sight in proper alignment with the rear sight. With the training aid 2 attached to the firearm, the rear sight abuts the tunnel 26 and is contained within the pocket 28 of the training aid 2. As a result, when trying to view the rear sight, the hood 8 forces a user to look through the rear sight properly. If the user attempts to view the rear sight from a low point, the user will only view the roof of the tunnel 26 and will be unable to see the front sight. If the user tries to view the rear sight from a high point, the user will only see the third surface 14 forming the center 12. The user is therefore compelled to view the rear sight directly behind the rear sight and look through the tunnel 26 and will properly encounter the front sight. Similarly, if the user tries to look through the rear sight from a left or right point, they will not be able to peer properly through the tunnel 26 and will not be able to see the front sight.

The depth of the tunnel 26 and shape of the window 10 may also be changed without departing from the scope of the invention. The object of the invention is to compel the user to properly line up the rear sight with the front sight through the use of a removably attached training aid 2. The training aid preferably can simply be snapped into place by elastically expanding the distance between the first leg 18 and the second leg 20. The rear sight of the firearm may then be placed into the window 10 and the first leg 18 and second leg 20 be released so that the firearm is secured within the slot 30. Grips 6 may also be provided along the first leg 18 and the second leg 20 to provide increased frictional resistance. The frictional resistance may be useful when the training aid 2 is used with a semi-automatic firearm such as a Glock® pistol. The grips 6 allow the user properly grip the slide when chambering a round. The grips may include vertical slots as shown, but may also include any other pattern of surface deformations to promote frictional resistance.

I claim:

1. A firearm training aid comprising:

a first planar surface configured to abut alongside at least a first portion of a firearm;

a second planar surface opposite the first surface configured to abut alongside a second portion of the firearm opposite the first portion of the firearm;

a third planar surface joining the first and second planar surfaces thereby forming a substantially U-shaped training aid by the first, second, and third planar surfaces, wherein the third planar surface abuts alongside a third portion of the firearm between the first portion and the second portion of the firearm;

a window formed in the third planar portion configured to receive a rear sight of the firearm; and a hood extending from an intersection of the first and third planar surfaces and from an intersection of the second and third planar surfaces, wherein the hoop is configured to shroud the rear sight of the firearm when it is inserted through the window.

2. The firearm training aid according to claim 1, wherein the first, second, and third planar surfaces are configured to removably attach to a slide of a semi-automatic firearm.

3. The firearm training aid according to claim 1, wherein the first, second, and third planar surfaces are configured to removably attach to a revolver.

4. The firearm training aid according to claim 1, wherein the first, second, and third planar surfaces are configured to removably attach to a long gun.

5. The firearm training aid according to claim 1, further comprising a plurality of grip enhancements on at least a portion of the first planar surface and the second planar surface.

6. The firearm training aid according to claim 1, wherein the first, second, and third planar surfaces are each substantially planar thereby joined at each respective intersection at right angles.

7. The firearm training aid according to claim 1, wherein the first, second, third planar surfaces and hood are all formed from a single, monolithic structure.

8. A rear sight cover for a semiautomatic firearm comprising:

a substantially "U" shaped cover including a first leg, a second leg, and a center, wherein the center joins the first and second legs, wherein the "U" shaped cover is configured to removably attach to a slide of the semi-automatic firearm;

a window formed in the center of the "U" shaped cover configured to expose a portion of the slide when the "U" shaped cover is attached to the slide;

a hood extending above the window from the "U" shaped cover forming a pocket between the window and the hood; and wherein a rear sight affixed to the slide nests within the pocket such that the hood contacts at least a portion of the rear sight.

9. The firearm training aid according to claim 8, wherein the first and second leg join the center to at least partially conceal a slide of a semiautomatic firearm.

10. The firearm training aid according to claim 8, wherein the first and second leg are configured to engage a rear portion of a revolver.

11. The firearm training aid according to claim 8, wherein the first and second leg are configured to engage opposing sides of a long gun and the center rests on a top portion of the long gun.

12. The firearm training aid according to claim 8, further comprising a plurality of grip enhancements on at least a portion of the first and second legs.

13. The firearm training aid according to claim 8, wherein the first and second legs are parallel and the center joins the first and second legs at right angles.

14. The firearm training aid according to claim 8, wherein both a rear and front sight of the firearm may be seen through the hood when the firearm training aid is affixed to a firearm.

15. A firearm rear sight attachment comprising:

a removable attachment configured for engagement with a firearm with a frictional engagement;

a window formed in a portion of the attachment;

a hoop at least partially covering an area above the window forming a tunnel along the longitudinal axis of the attachment, wherein a front sight and the rear sight of the firearm may be viewed along the longitudinal axis of the attachment through the tunnel; and wherein the hoop contacts at least a portion of the rear sight such that a user may observe the rear and front sight by looking into the tunnel of the attachment.

16. The firearm rear sight attachment according to claim 15, wherein both the rear sight and a front sight of the firearm may be viewed through the hoop when the rear sight attachment is attached to the firearm.

17. The firearm rear sight attachment according to claim 15, further comprising:

a first leg forming a side of the rear sight attachment;

a second leg forming an opposing side of the rear sight attachment; and wherein the first and second leg are parallel.

18. The firearm rear sight attachment according to claim 17 further comprising a third surface at a center of the rear sight attachment joining the first and second leg, and wherein the window is formed in the third surface.

19. The firearm rear sight attachment according to claim 18, wherein the hoop projects from an intersection of the first and second legs with the center third surface, thus forming the tunnel above the window.

20. The firearm rear sight attachment according to claim 15, wherein the rear sight attachment is configured for attachment to a slide of a semi-automatic firearm.

* * * * *